US006634044B1

(12) United States Patent
Wright

(10) Patent No.: US 6,634,044 B1
(45) Date of Patent: Oct. 21, 2003

(54) COMPACT STRETCHER

(76) Inventor: Linda Wright, 5972 Redburn Ave., Marysville, CA (US) 95901

( * ) Notice: Subject to any disclaimer, the term of this patent is extended or adjusted under 35 U.S.C. 154(b) by 0 days.

(21) Appl. No.: 10/176,475

(22) Filed: Jun. 18, 2002

(51) Int. Cl.[7] ..... A61G 1/013
(52) U.S. Cl. ..... 5/625; 5/627; 5/626; 5/81.1 T
(58) Field of Search ..... 5/89.1, 625, 626, 5/627, 81.1 T, 417; 294/140

(56) References Cited

U.S. PATENT DOCUMENTS 2,385,067 A * 9/1945 Egardner ..... 5/627
5,442,821 A * 8/1995 Weeks ..... 5/89.1
5,774,912 A * 7/1998 Dominique ..... 5/419
5,839,137 A * 11/1998 Butler et al. ..... 5/627
5,978,989 A * 11/1999 Chavez ..... 5/627
6,223,367 B1 * 5/2001 French et al. ..... 5/419
6,393,638 B1 * 5/2002 MacColl ..... 5/419

* cited by examiner

*Primary Examiner*—Michael F. Trettel
(74) *Attorney, Agent, or Firm*—Theodore J. Bielen, Jr.

(57) ABSTRACT

A compact stretcher usable to transport a body having a sheet with a first surface and a second opposite surface. The first surface of the sheet possesses sufficient area to underlie and support a body being transported. The peripheral edge between the first and second surfaces which serves as a place for location of handles. A flange having a pocket is connected to the sheet and is of sufficient size to accommodate the sheet in a rolled configuration.

6 Claims, 3 Drawing Sheets

COMPACT STRETCHER

BACKGROUND OF THE INVENTION

The present invention relates to a novel and useful compact stretcher.

Persons suffering from debilitating illnesses often need to be transported from a particular place to a medical facility. In many cases, the persons moved by an ambulance to a medical facility. However, moving a patient from a place of entry to an ambulance requires a stretcher of other mobile transporters such as gurneys, wheelchairs, and the like.

Unfortunately, conventional stretchers, gurneys, and wheelchairs, although in part collapsible, are bulky and may be difficult to locate to a particular site. This is an especially acute problem in remote areas lacking roads and railways.

A compact stretcher for transporting a body would be a notable advance in the medical field.

BRIEF SUMMARY OF THE INVENTION

In accordance with the present invention a novel and useful compact stretcher for a body is herein provided.

The stretcher of the present invention utilizes a sheet having a first surface and a second opposite surface. The sheet may be formed of any flexible material such as nylon, cotton, polymeric cloth, and the like. The sheet is formed of a sufficient size to underlie the body of a person being transported. A peripheral edge separates the first and second surfaces of the sheet and may be formed into an endless member. The sheet peripheral edge may serve as a place for extension of a plurality of handles which are manipulated by a multiplicity of persons to lift a body lying on the sheet of the stretcher of the present invention.

The plurality of handles may be formed into two lines or rows, one lying at the peripheral edge of the sheet and other rows of handles lying inwardly from the peripheral edge at the second surface of the sheet. In this manner, the sheet may be employed to hold persons of different sizes and configurations, as well as to provide gripping areas to the users in order to maneuver the stretcher in a particular manner.

A flange is also found in the present invention and connected to the flexible sheet on the first surface of the same. The flange is provided with a pocket which is of sufficient size to accommodate the sheet in a rolled configuration.

Means is also included in the present invention for at least partially enclosing the pocket. Such enclosing means may take the form of snaps, buttons, zippers, hook and pile fasteners, and the like. In the enclosed position, a pair of handles of the plurality of handles lies outside the pocket and may then be employed to carry the sheet and flange of the stretcher of the present invention in a convenient manner.

It may be apparent that a novel and useful compact stretcher has been hereinabove described.

It is therefore an object of the present invention to provide a compact stretcher for moving a body which is flexible and may be easily stored for use.

Another object of the present invention is to provide a compact stretcher for a body which may be rolled into a tight configuration which is easily placed into a bag for storage.

Another object of the present invention is to provide a compact stretcher for a body which includes a flange having a pocket such that a majority of the stretcher may be placed in the pocket and formed into a satchel-like shape to facilitate the carrying of the stretcher of the present invention.

Yet another object of the present invention is to provide a compact stretcher for a body which includes provision for carrying persons that are of varying sizes and shapes.

Yet another object of the present invention is to provide a compact stretcher for a body which may be easily manufactured and is durable.

The invention possesses other objects and advantages especially as concerns particular characteristics and features thereof which will become apparent as the specification continues.

For a better understanding of the invention reference is made to the following detailed description of the preferred embodiments which should be referenced to the prior described drawings.

DETAILED DESCRIPTION OF THE PREFERRED EMBODIMENTS OF THE INVENTION

Various aspects of the present invention will evolve from the following detailed description of the preferred embodiments thereof which is best referenced to the hereinabove-delineated drawings.

Figure 1:
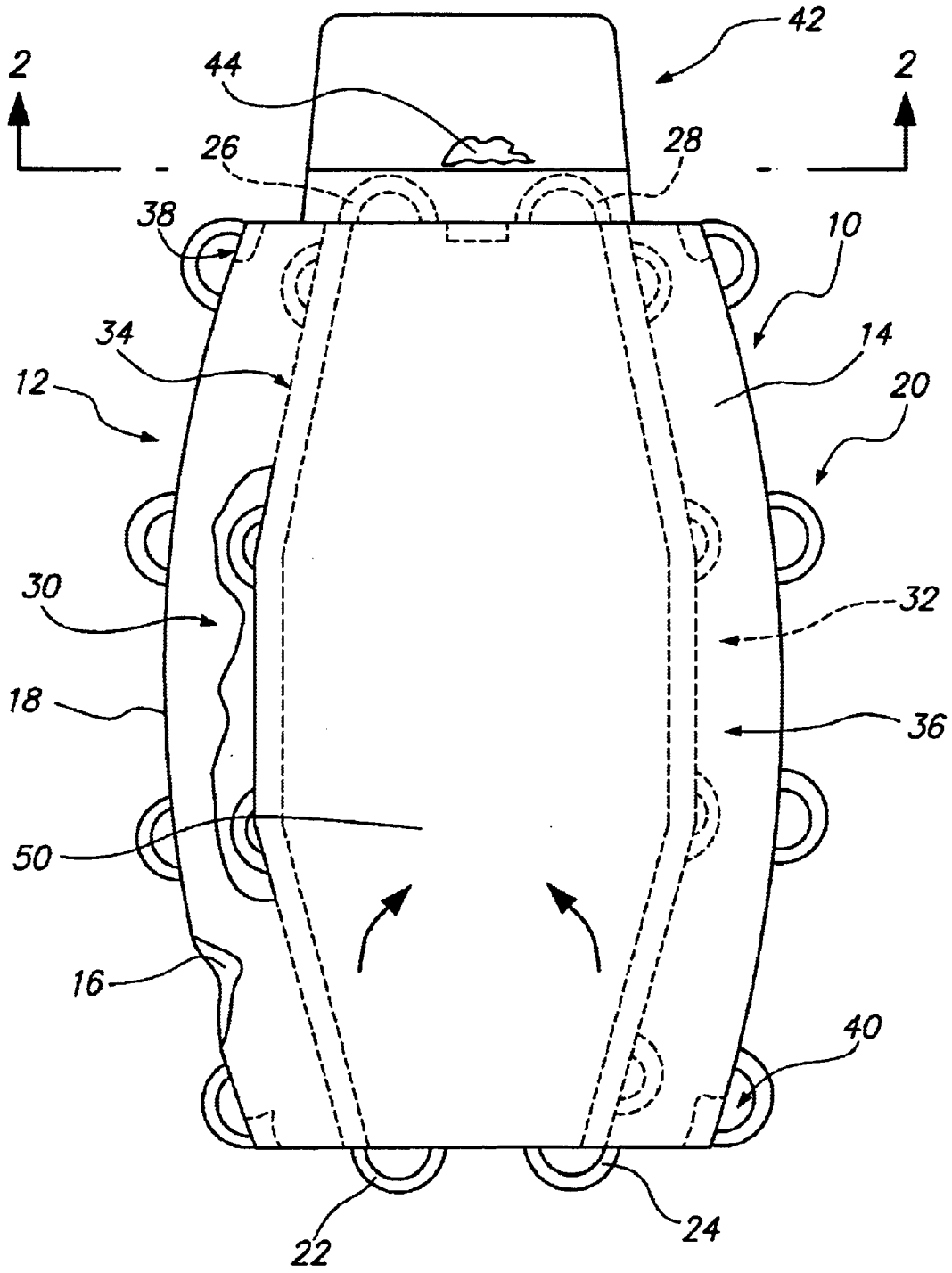
FIG. 1 is a top plan view of the stretcher of the present invention depicting a pair of rows and handles in phantom on the underside portion.

The preferred embodiment of the present invention is shown in its entirety by reference character 10. Compact stretcher 10 is illustrated in FIG. 1 in its extended position. Stretcher 10 includes as one of its elements a sheet 12 having a first surface 14 and a second surface 16, shown partially in FIG. 1. Peripheral edge 18 extends about sheet 12, and takes the form of an endless element in the embodiment depicted in the drawings. Flexible sheet 12 may be constructed of any suitable cloth-like material.

Stretcher 10 also is fashioned with a plurality of handles 20 that extend outwardly from peripheral edge 18. End handles 22 and 24 aid in the support and maneuvering of stretcher 10 when stretcher 10 is carrying heavy bodies. Handles 26 and 28 lie adjacent second side 16 of sheet 12 (in phantom on FIG. 1), the importance of which will be discussed hereinafter. Also, rows of handles 30 and 32 lie at second surface 16 and are held in place by stitch lines 34 and 36. Likewise, stitch lines 38 and 40 secure the remainder of plurality of handles 20 at peripheral edge 18 (partially shown in FIG. 1).

Figure 2:
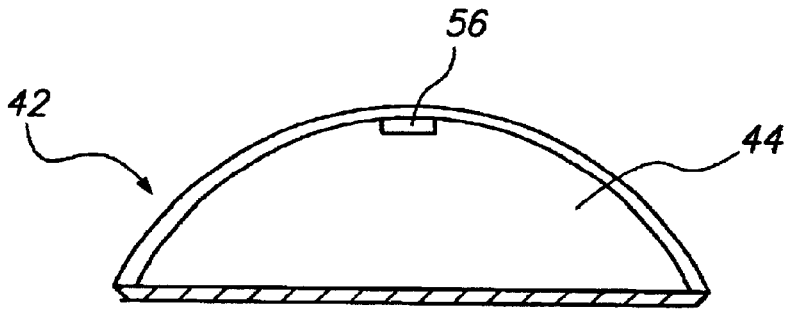
FIG. 2 is a sectional view taken along line 2—2 of FIG. 1.
Figure 3:
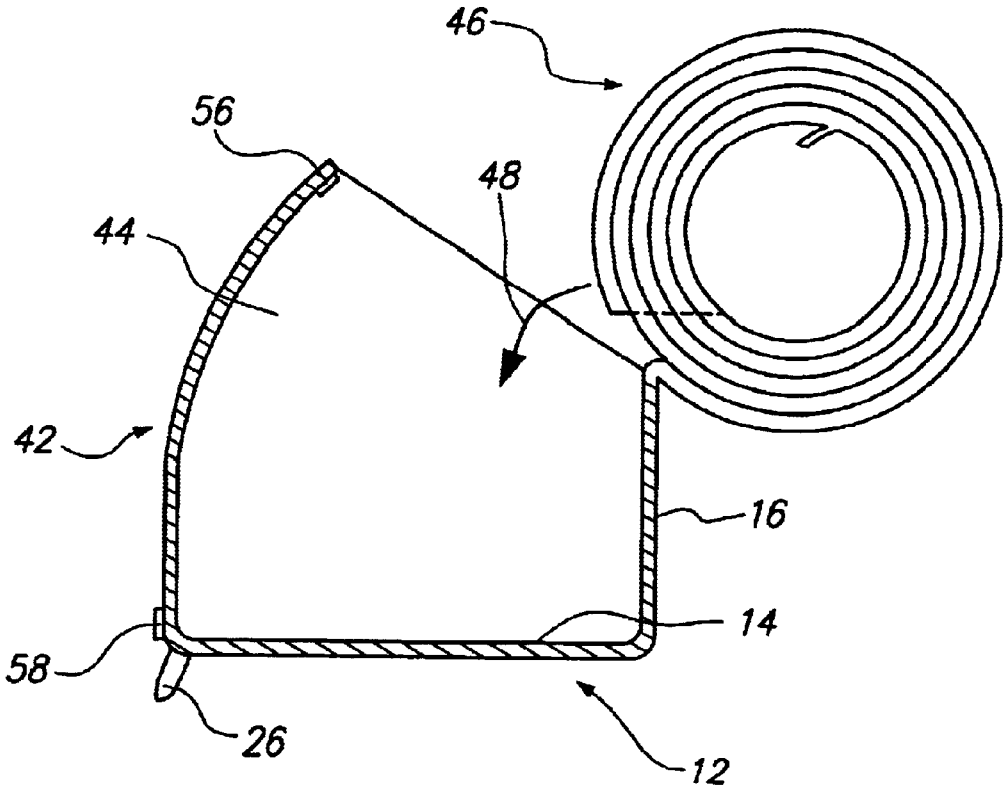
FIG. 3 is a sectional view showing the open pocket of the flange accepting a rolled sheet which is depicted schematically.

Flange 42 connects to the sheet 12 and extends outwardly from peripheral edge 18. Flange 42 may be integrally formed with sheet 12 or connected thereto by any suitable fastening means. Flange 42 includes a pocket 44. With reference to FIGS. 2 and 3, it may be observed that pocket 44 of flange 42 is sufficiently large to accept sheet 12 in a rolled configuration 46, shown schematically in FIG. 3. Directional arrow 48 indicates the intended positioning of rolled configuration 46 of sheet 12 within pocket 44.

Figure 4:
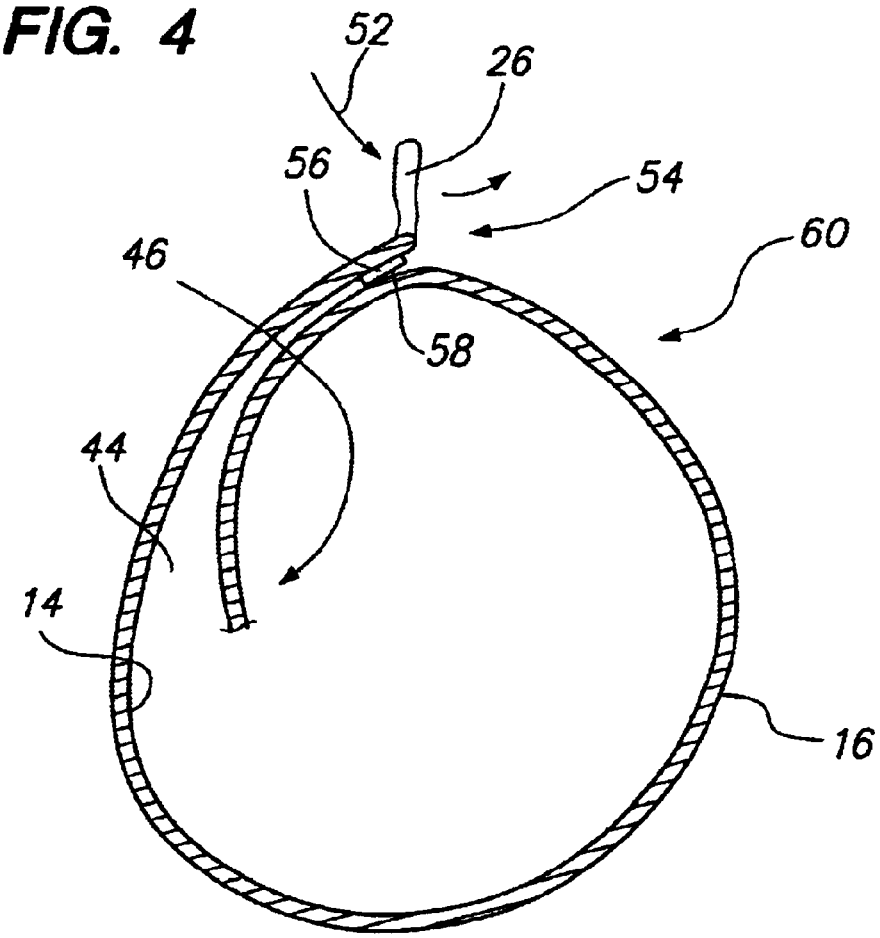
FIG. 4 is a sectional view of the satchel configuration of the stretcher of the present invention with the rolled sheet shown partially.
Figure 5:
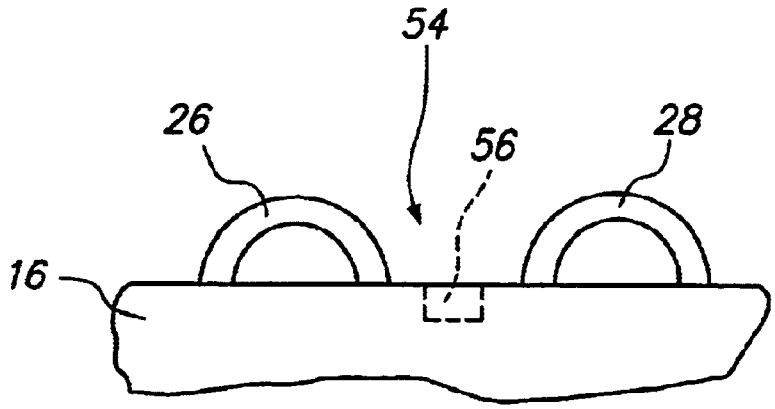
FIG. 5 is a partial front elevational view of the handle portion of the satchel configuration depicted in FIG. 4 of the stretcher of the present invention.

In operation, stretcher 10 is caused to assume the position depicted in FIG. 1 such that a body may be placed on central area 50 of first side 14 of sheet 12. Plurality of handles 20 are then employed by multiple persons to lift stretcher 10 and the body found thereupon. After transportation to an ambulance or medical facility, stretcher 10 is rolled to configuration 46 depicted in FIG. 3. Sheet 12 is then placed within pocket 44 of flange 42 as shown in FIG. 4. Configuration 46 is shown partially in FIG. 4. At this point, stretcher 10 resembles a satchel such that handle 26 is available for use and may be held by the hand of a user. Handle 28 is also available for gripping at this time. Directional arrows 52 indicate the movement of a hand through handle 26 on FIG. 4. Means 54 is employed to enclose pocket 44. Means 54 is shown to take the form of fastening members 56 and 58 which interlink or mate. For example, Velcro hook and pile fasteners may be employed in this regard. In essence, sheet 12 and flange 42, formed into a satchel configuration 60, depicted in FIG. 4, remains so during movement. Compact stretcher 10 is easily transported and stored in this configuration for use in the future. When such use is needed, fastening means 54 is undone and stretcher 10 is extended or laid out into the configuration shown in FIG. 1.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A compact stretcher for a body, comprising:

a. a flexible sheet having a first surface and a second opposite surface, said first surface being of sufficient area to underlie the body, said first and second surfaces meeting at a peripheral edge portion;

b. a plurality of handles located at said sheet and at said peripheral edge portion, thereof;

c. a flange, said flange being connected to said sheet and including a pocket, said pocket being accessible on said first surface of said sheet and being of sufficient size to accommodate said sheet in a rolled configuration; and d. means for at least partially enclosing said pocket with at least one handle of said plurality of handles lying outside said pocket, said means for at least partially enclosing said pocket comprises a first fastening member located at said pocket, and a second fastening member located at said second surface of said sheet, said first and second fastening members interacting to at least partially enclose said pocket.

2. The stretcher of claim 1 in which at least one of said plurality of handles is positioned outside of said pocket when said sheet lies in a rolled configuration and being accommodated by said pocket.

3. The stretcher of claim 1 in which said first and second fastening means comprise hook and pile fasteners.

4. The stretcher of claim 1 which additionally comprises said plurality of handles forming at least one row of handles located at said second surface of said sheet inwardly from said peripheral edge.

5. The stretcher of claim 4 in which at least one of said plurality of handles is positioned outside of said pocket when said sheet in a rolled configuration and being accommodated by said pocket.

6. The stretcher of claim 4 in which said first and second fastening means comprise hook and pile fasteners.

* * * * *